US006231731B1

(12) United States Patent
Kondo et al.

(10) Patent No.: US 6,231,731 B1
(45) Date of Patent: May 15, 2001

(54) ELECTROLYZING ELECTRODE AND PROCESS FOR THE PRODUCTION THEREOF

(75) Inventors: Makoto Kondo; Hiroyuki Nakada; Yukio Kawashima, all of Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/292,841

(22) Filed: Apr. 16, 1999

(30) Foreign Application Priority Data

Apr. 24, 1998 (JP) ..... 10-131333

(51) Int. Cl.[7] ..... C25B 11/00

(52) U.S. Cl. ..... 204/290.03; 204/290.12; 204/290.14; 427/126.5; 427/383.7; 427/405; 427/419.2; 427/419.8

(58) Field of Search ..... 204/290.03, 290.06, 204/290.08, 290.12, 290.14, 290.09; 427/98, 126.5, 383.7, 405, 419.2, 419.8

(56) References Cited

U.S. PATENT DOCUMENTS 5,294,317 * 3/1994 Saito et al. ..... 204/290.09

FOREIGN PATENT DOCUMENTS 0 383 470 8/1990 (EP) .
0 531 264 3/1993 (EP) .
0 699 780 3/1996 (EP) .
5-171483 7/1993 (JP) .
5-230682 9/1993 (JP) .
5-255881 10/1993 (JP) .
5-287572 11/1993 (JP) .
2505560 4/1996 (JP) .
2505563 4/1996 (JP) .
8-225977 9/1996 (JP) .
2574699 10/1996 (JP) .

* cited by examiner

*Primary Examiner*—Bruce F. Bell
(74) *Attorney, Agent, or Firm*—Oblon, Spivak, McClelland, Maier & Neustadt, P.C.

(57) ABSTRACT

An electrolyzing electrode which is for electrolyzing a metal electrolytic solution, shows a long lifetime in use as an ordinary anode and has sufficient durability even when in a poor potential region, and a process for the production thereof. The electrolyzing electrode of the present invention has an undercoating layer which is formed of platinum metal and tantalum oxide and contains, as metals, 1 to 20 at % of platinum and 80 to 99 at % of tantalum, on an electrically conductive electrode substrate, has an intermediate layer which is formed of iridium oxide and tantalum oxide and contains, as metals, 70 to 99.9 at % of iridium and 0.1 to 30 at % of tantalum, on the undercoating layer, and further has an overcoating layer which is formed of platinum metal and iridium oxide and contains, as metals, 60 to 99.9 at % of platinum and 0.1 to 40 at % of iridium, on the intermediate layer.

5 Claims, No Drawings

ELECTROLYZING ELECTRODE AND PROCESS FOR THE PRODUCTION THEREOF

BACKGROUND OF THE INVENTION

1. Field of the Invention

The present invention relates to an electrolyzing electrode for use in an industrial and civilian-use electrolysis process and a process for the production thereof. More specifically, it relates to an electrolyzing electrode which is for electrolyzing a metal electrolytic solution for carrying out a plating, which is used as an anode for a reaction to generate oxygen on the anode and is excellent in durability in the reaction, and which has excellent durability even when it is placed in a poor potential region, and a process for the production thereof.

2. Prior Art of the Invention

Conventionally, a metal electrode formed by providing metal titanium as an electrically conductive substrate and forming a coating of a metal coming under the group of platinum or its oxide thereon is used in the various fields of electrolysis industry. For example, an electrode formed by coating a titanium substrate with oxides of ruthenium and titanium or oxides of ruthenium and tin by a pyrolysis method is known as an anode for generating chlorine by the electrolysis of sodium chloride (Japanese Patent Publications Nos. 46-21884, 48-3954 and 50-11330 and JP-A-52-63176).

The above electrode is suitable for the electrolysis of an aqueous solution containing a high concentration of sodium chloride such as the electrolysis of sodium chloride. In the electrolysis of an aqueous solution containing a low concentration of sodium chloride and the hydrolysis of sea water, however, the above electrode has no sufficient durability, and the efficiency of chlorine generation is not fully satisfactory, either.

Further, as an electrode for the electrolysis of an aqueous solution of an alkali metal halide such as sodium chloride, JP-A-55-152143 and JP-A-56-150148 disclose an electrode formed of an amorphous alloy as an electrode material. However, the amorphous alloy requires a large-scale apparatus for producing the same.

In addition to the electrolysis which involves the generation of chlorine such as the above electrolysis of sodium chloride, the electrolysis industry in various fields uses electrolysis processes which involve the generation of oxygen, such as the recovery of an acid, an alkali or a salt, the collection and purification of a metal such as copper or zinc, plating, the production of a foil of a metal such as copper, the treatment of a metal surface, the prevention of corrosion of a cathode and the disposal of a waste. In the above electrolysis which involves the generation of oxygen, as an insoluble electrode, there are used iridium-oxide-based electrodes or platinum-plated titanium electrodes, such as an electrode formed by coating a titanium substrate with iridium oxide and platinum, an iridium oxide-tin oxide electrode and an iridium oxide-tantalum oxide electrode.

When an electrode formed by coating a titanium substrate is used as an anode to carry out the electrolysis which involves the generation of oxygen, generally, the anode is passivated due to the formation of a titanium oxide layer between the substrate and a coating layer, and the titanium substrate is corroded, so that the anode potential gradually increases, which results in the end of the lifetime of the anode. Further, the coating layer may peel off. For inhibiting the formation of titanium oxide on the titanium substrate and the corrosion of the titanium substrate to prevent the passivation of the anode, there have been made various proposals in selecting proper coating layers or forming proper undercoating layers.

For example, JP-A-5-287572 proposes an electrode for the generation of oxygen, which electrode comprises an electrically conductive substrate, an iridium oxide/tantalum oxide undercoating layer which contains, as metals, 8.4 to 14 mol % of iridium and 86 to 91.6 mol % of tantalum and is formed on the electrically conductive substrate, and an iridium oxide/tantalum oxide overcoating layer which contains, as metals, 80 to 99.9 mol % of iridium and 0.1 to 20 mol % of tantalum and is formed on the above undercoating layer.

Further, JP-A-5-171483 proposes an anode for the generation of oxygen, which anode comprises an electrically conductive substrate, an intermediate layer which is composed of metal tantalum and/or tantalum alloy as main component(s) and is formed on the electrically conductive substrate by plasma spray coating with metal tantalum and/or a tantalum alloy powder and an electrode activation layer which contains at least 20% by weight of iridium oxide and a balance of tantalum oxide and is formed on the above intermediate layer.

Japanese Patent Publication No. 2574699 proposes an electrode for the generation of oxygen, which electrode comprises an electrically conductive substrate, an intermediate layer which is composed of crystalline metal tantalum and is formed on the electrically conductive substrate by a sputtering method and an electrode activation layer which contains a metal coming under the group of platinum or its oxide (iridium oxide, etc.) and is formed on the intermediate layer.

Meanwhile, in metal plating, anodes consist of a pair of flat plates parallel with each other, and a board to be plated is carried therebetween. When both the surfaces of the board are plated, the two electrodes are used as positive polarizations. When one surface is plated, one electrode is used as a positive polarization. When only one of the two electrodes is used as a positive polarization, the other is exposed to a poor potential region, and in some cases, it comes to be a negative polarization.

When used as an ordinary anode, the above electrode has sufficient durability. However, when the electrode is exposed to a poor potential region, the problem is that a catalyst is exhausted to a greater extent so that the durability of the electrode extremely decreases. The reason therefor is mainly as follows. The electrode is brought into a reduced state and the surface of the electrically conductive substrate is therefore embrittled due to hydrogen so that the coherence to a catalyst is removed, and iridium oxide having a high catalytic performance comes to be completely reduced.

As described above, practically, the electrode is not only required to have a durability as a positive polarization, but also required to have sufficient durability even when it is placed in a poor potential region. Various studies are therefore being made on methods of improving corrosion resistance in a reduced state, in which, in sulfuric acid electrolysis, platinum poor in corrosion resistance is added to decrease a hydrogen overpotential.

JP-A-5-230682 discloses an electrolyzing electrode comprising an electrically conductive substrate, an intermediate layer which is composed of a platinum layer containing platinum as a main component and an oxide layer containing oxides of valve metals (titanium, tantalum, niobium, zirconium and tin) as main components and an electrode activation material layer coated on the intermediate layer. This electrode has durability for a negative polarization. However, when it is used as an anode for electrolysis in an acidic solution of a sulfuric acid, an electrolytic solution infiltrates into the interior of the electrode to reach the platinum layer, and the platinum is exhausted, so that it is insufficient in durability.

Further, Japanese Patent Publication No. 2505563 discloses an electrolyzing electrode comprising an electrode substrate formed of titanium or a titanium alloy, an intermediate layer which is composed of platinum dispersed and coated on the electrode substrate at a coverage ratio of 10 to 80% and other metal oxides (0 to 20 mol % of iridium oxide, manganese oxide, cobalt oxide, tin oxide and antimony oxide and 80 to 100 mol % of niobium oxide, tantalum oxide and zirconium oxide) filling in spaces thereof, and an outer layer which is composed of 5 to 94 mol % of iridium oxide, 1 to 30 mol % of platinum and 5 to 94 mol % of oxide of valve metal and formed on the intermediate layer. This electrode has durability for a negative polarization. However, when it is used as an anode for electrolysis in an acid solution of a sulfuric acid, it is insufficient in durability since platinum being contained in both the intermediate layer and the outer layer is exhausted.

JP-A-5-255881 discloses an electrode for the generation of oxygen, which comprises an electrically conductive substrate, a platinum metal/tantalum oxide undercoating layer which contains, as metals, 1 to 20 mol % of platinum and 80 to 99 mol % of tantalum and is formed on the electrically conductive substrate, an iridium oxide/tantalum oxide intermediate layer which contains, as metals, 80 to 99.9 mol % of iridium and 20 to 0.1 mol % of tantalum and is formed on the undercoating layer, and an iridium oxide/tantalum oxide overcoating layer which contains, as metals, 40 to 79.9 mol % of iridium and 60 to 20.1 mol % of tantalum and is formed on the intermediate layer.

JP-A-8-225977 discloses an electrolyzing electrode comprising a titanium substrate, an alloy layer which is composed of titanium, platinum and tantalum and is formed on the titanium substrate, an intermediate layer which is composed of 5 to 30 mol % of iridium oxide and 70 to 95 mol % of tantalum oxide and is formed on the ally layer surface and an outer layer which is composed of 60 to 98 mol % of iridium oxide and 2 to 40 mol % of tantalum oxide and is formed on the intermediate layer.

Japanese Patent Publication No. 2505560 discloses an electrolyzing electrode comprising an electrode substrate formed of titanium or a titanium alloy, an intermediate layer which is composed of platinum dispersed and coated on the electrode substrate at a coverage ratio of 10 to 80% and other metal oxides (0 to 20 mol % of iridium oxide, manganese oxide, cobalt oxide, tin oxide and antimony oxide and 80 to 100 mol % of niobium oxide, tantalum oxide and zirconium oxide) and is formed on the electrode substrate, and an outer layer which is composed of 5 to 95 mol % of iridium oxide and 5 to 95 mol % of oxides of valve metals (niobium, tantalum and zirconium) and is formed on the intermediate layer.

The above electrodes have durability for a negative polarization to some extent. However, when the thickness of a catalyst layer (intermediate layer) is increased for attaining a longer lifetime of the electrode, the effect of platinum incorporated into the undercoating layer decreases, and the durability for a negative polarization decreases.

As described above, there has been obtained no electrolyzing electrode which has a long lifetime in ordinary electrolysis and has sufficient durability when placed in a poor potential region.

SUMMARY OF THE INVENTION

It is an object of the present invention to provide an electrolyzing electrode which is for electrolyzing a metal electrolytic solution, which has a long lifetime in use as an ordinary anode and which has sufficient durability even when placed in a poor potential region.

The present inventors have made diligent studies for developing an electrode for the generation of oxygen, which has excellent durability and which can be used for a long period of time even when placed in a poor potential region. As a result, it has been found that the exhaustion of a catalyst is less influenced by the addition of platinum and that the overpotential is reduced to a great extent so that that the durability in a poor potential region is remarkably improved, by adding platinum metal to a tantalum oxide coating layer on an electrically conductive substrate such as a titanium substrate, forming an intermediate layer composed of iridium oxide and tantalum oxide on the above platinum-metal-containing undercoating layer and further forming an overcoating layer composed of platinum and iridium oxide on the intermediate layer. The present invention has been completed on the basis of the above findings.

That is, the above object is achieved by the present invention to be described below.

(1) An electrolyzing electrode having an undercoating layer which is formed of platinum metal and tantalum oxide and contains, as metals, 1 to 20 at % of platinum and 80 to 99 at % of tantalum, on an electrically conductive electrode substrate, having an intermediate layer which is formed of iridium oxide and tantalum oxide and contains, as metals, 70 to 99.9 at % of iridium and 0.1 to 30 at % of tantalum, on the undercoating layer, and further having an overcoating layer which is formed of platinum metal and iridium oxide and contains, as metals, 60 to 99.9 at % of platinum and 0.1 to 40 at % of iridium, on the intermediate layer.

(2) An electrolyzing electrode according to the above (1), which is for use as an anode and can be exposed to a poor potential region.

(3) An electrolyzing electrode according to the above (1) or (2), wherein the electrically conductive electrode substrate is a substrate formed of a titanium substrate and a tantalum layer formed on the titanium substrate.

(4) A process for the production of the electrolyzing electrode of any one of the above (1) to (3), which process comprises applying a solution containing a platinum compound and a tantalum compound onto an electrically conductive electrode substrate, then, heat-treating a resultant layer in an oxidizing atmosphere to form an undercoating layer which is composed of platinum metal and tantalum oxide and contains, as metals, 1 to 20 at % of platinum and 80 to 99 at % of tantalum on the electrically conductive electrode substrate, then, applying a solution containing an iridium compound and a tantalum compound onto the undercoating layer, heat-treating a resultant layer in an oxidizing atmosphere to form an intermediate layer which is composed of iridium oxide and tantalum oxide and contains, as metals, 70 to 99.9 at % of iridium and 0.1 to 30 at % of tantalum on the undercoating layer, further, applying a solution containing a platinum compound and an iridium compound onto the intermediate layer, and heat-treating a resultant layer in an oxidizing atmosphere to form an overcoating layer which is formed of platinum metal and iridium oxide and contains, as metals, 60 to 99.9 at % of platinum and 0.1 to 40 at % of iridium, on the intermediate layer.

The electrolyzing electrode of the present invention has an undercoating layer which is formed of platinum metal and tantalum oxide and contains, as metals, 1 to 20 at % of platinum and 80 to 99 at % of tantalum, on an electrically conductive electrode substrate, has an intermediate layer which is formed of iridium oxide and tantalum oxide and contains, as metals, 70 to 99.9 at % of iridium and 0.1 to 30 at % of tantalum, on the undercoating layer, and further has an overcoating layer which is formed of platinum metal and iridium oxide and contains, as metals, 60 to, 99.9 at % of platinum and 0.1 to 40 at % of iridium, on the intermediate layer.

In the above electrode, the second layer, i.e., the intermediate layer formed of iridium oxide and tantalum oxide is a catalyst layer. The first layer, i.e., the undercoating layer formed of platinum metal and tantalum oxide works as an adhesive layer, and the third layer, i.e., the overcoating layer formed of platinum metal and iridium oxide works as a protective layer. The overcoating layer is also effective for increasing the catalytic performance.

Iridium has a low oxygen overpotential and shows a high catalytic performance as an electrode for the generation of oxygen. The catalyst layer contains tantalum for improving corrosion resistance. As described already, however, there is a problem that when an electrode is exposed in a poor potential environment, the electrode is deteriorated in durability since the catalyst is exhausted to a greater extent. In the present invention, platinum having a low hydrogen overpotential is incorporated into the undercoating layer and the overcoating layer, and the catalyst layer is sandwiched between the layers containing platinum, so that the durability in a poor potential region is remarkably improved and that sufficient durability is materialized even in ordinary electrolysis.

DETAILED DESCRIPTION OF THE INVENTION

The electrically conductive substrate for use as the electrode of the present invention includes valve metals such as titanium, tantalum, zirconium and niobium, and alloys or multi-layered structures of at least two metals selected from these valve metals. Titanium is preferred as a substrate, and tantalum is preferred as a coating layer of a multi-layered structure. A substrate formed by coating titanium with tantalum provides a longer lifetime of the electrode. Tantalum can be coated on titanium by a sputtering method, a deposition method, a cladding method or a spray coating method. The thickness of the coating layer of tantalum is approximately 0.5 $\mu$m to 5 mm.

In the electrode of the present invention, a layer formed of platinum metal and tantalum oxide as an undercoating layer is coated on the above electrically conductive substrate. Concerning the amount ratio of platinum and tantalum of the undercoating layer, the content of platinum as a metal is in the range of from 1 to 20 at %, and the content of tantalum as a metal is in the range of from 80 to 99 at %. Preferably, the content of platinum is in the range of from 5 to 15 at %, and the content of tantalum is in the range of from 85 to 95 at %. When the content of platinum is small, the effect of the undercoating layer on a decrease in a hydrogen overpotential is low. When the content of platinum is large, platinum which is liable to be eluted works as a catalyst, which leads to the peeling of the coating layer.

In the above undercoating layer, further, it is referred to apply platinum and tantalum oxide in an amount, as metals, of 0.1 to 3 mg/cm$^2$. When the above amount is less than 0.1 mg/cm$^2$, the undercoating layer no longer has an effect as an adhesive layer to the electrically conductive substrate. When it exceeds 3 mg/cm$^2$, the electrical conductivity decreases, and a sharp voltage increase is caused.

When the undercoating layer having platinun and tantalum oxide contents in the above ranges and the overcoating layer are combined, an increase in the hydrogen overpotential can be inhibited, and no sharp acceleration of exhaustion takes place in ordinary electrolysis.

The undercoating layer may contain iridium oxide in an amount, as a metal, of 10 at % or less of iridium in addition to platinum and tantalum oxide.

In the present invention, an intermediate layer formed of iridium oxide and tantalum oxide is coated on the above undercoating layer. Concerning the amount ratio of iridium oxide and tantalum oxide of the intermediate layer, the content of iridium as metal is in the range of from 70 to 99.9 at %, and the content of tantalum as a metal is in the range of from 0.1 to 30 at %. When the content of iridium oxide is larger in the above range, a favorable result can be obtained. When the content of iridium oxide is too large, however, the adhesion strength decreases, and no sufficient effect is exhibited. When the content of iridium oxide is too small, an increase in a hydrogen overpotential is incurred.

In the above intermediate layer, it is preferred to apply iridium oxide in an amount, as iridium, of 0.5 to 7 mg/cm$^2$, particularly 2 to 6 mg/cm$^2$, more preferably 2.5 to 6 mg/cm$^2$, still more preferably 3 to 6 mg/cm$^2$. When the content of iridium is less than 0.5 mg/cm$^2$, the catalyst amount is small, and as a result, no sufficient durability can be obtained. When it exceeds 7 mg/cm$^2$, the adhesion strength decreases.

In the present invention, an overcoating layer formed of platinum metal and iridium oxide is coated on the above intermediate layer. Concerning the amount ratio of platinum and iridium of the above overcoating layer, the content of platinum as a metal is in the range of from 60 to 99.9 at %, and the content of iridium as a metal is in the range of from 0.1 to 40 at %. When the content of platinum is small, platinum is all eluted in the initial stage of ordinary electrolysis, and the durability for a negative polarization decreases.

In the above overcoating layer, it is preferred to apply platinum and iridium oxide in an amount, as metals, of 0.1 to 3 mg/cm$^2$. When the above amount is less than 0.1 mg/cm$^2$, platinum is promptly exhausted so that an improvement in the durability for a negative polarization is decreased. When it exceeds 3 mg/cm$^2$, a large amount of platinum infiltrates the intermediate layer, and the exhaustion amount of the electrode increases.

When an electrode having an overcoating layer having platinum and iridium oxide contents in the above ranges is used for electrolysis in sulfuric acid, platinum contained in the overcoating layer is selectively eluted, while part thereof is diffused into the intermediate layer and exhibits an effect sufficient for decreasing the hydrogen overpotential. Further, since the intermediate layer itself contains no platinum, there is no case where the A catalyst is peeled off from the inside of the electrode.

The overcoating layer may contain 30 at %, as a metal, of tantalum oxide in addition to platinum and iridium oxide.

In the undercoating layer, the intermediate layer and the overcoating layer of the electrode of the present invention, generally, platinum is present in the form of a metal, and both iridium and tantalum are present in the form of oxides. The iridium oxide and the tantalum oxide may compositionally deviate from their stoichiometric compositions to some extent. Platinum is generally present in grain boundaries, while it may partially form a solid solution of it in oxides. Further, the iridium oxide and the tantalum oxide may be present alone, or they may be present in the form of composite oxides.

The process for the production of the electrolyzing electrode, provided by the present invention, will be explained hereinafter.

As an electrically conductive substrate, titanium or a substrate formed by chemically or physically Functioning tantalum onto titanium is used.

First, a solution containing a platinum compound and a tantalum compound is applied onto the electrically conductive substrate, and then, a resultant layer is heat-treated in an oxidizing atmosphere, to form an undercoating layer which is formed of platinum metal and tantalum oxide and contains, as metals, 1 to 20 at % of platinum and 80 to 99 at % of tantalum.

The solution for the above application can be prepared by dissolving predetermined amounts of a compound which forms platinum metal by pyrolysis, i.e., a platinum compound such as chloroplatinic acid ($H_2PtCl_6.6H_2O$) or platinum chloride, and a compound which forms tantalum oxide by pyrolysis, i.e., a tantalum compound selected from tantalum halides such as tantalum chloride or tantalum alkoxides such as tantalum ethoxide ($Ta(OC_2H_5)_5$) in a proper solvent.

The above solvent is not critical, and generally, it may be an alcohol, water, or the like. When an alkoxide is used, however, a solvent other than water, such as an alcohol, is used for avoiding the decomposition thereof.

The heat treatment in an oxidizing atmosphere is carried out after the layer formed by applying the above solution is dried, and it is generally carried out by firing the layer under an oxygen partial pressure of 0.05 atmospheric pressure or higher, generally in atmosphere, preferably at a temperature in the range of from 400 to 550° C. The application of the solution can be carried out by brushing, spraying or immersing. A series of the application and heat-treatment procedures are generally repeated a plurality of times until a necessary coating amount is attained.

A solution containing an iridium compound and a tantalum compound is applied onto the above-prepared undercoating layer, and then a resultant layer is heat-treated in an oxidizing atmosphere, to form an intermediate layer which is formed of iridium oxide and tantalum oxide and contains, as metals, 70 to 99.9 at % of iridium and 0.1 to 30 at % of tantalum.

The solution for the above application can be prepared by dissolving predetermined amounts of a compound which forms iridium oxide by pyrolysis, i.e., an iridium compound such as chloroiridic acid ($H_2IrCl_6.6H_2O$), iridium chloride or the like and a tantalum compound which forms tantalum oxide by pyrolysis, i.e., a tantalum compound selected from tantalum halides such as tantalum chloride or tantalum alkoxides such as tantalum ethoxide in a proper solvent.

The solvent is selected in the same manner as in the formation of the undercoating layer. Further, the heat treatment in an oxidizing atmosphere is also carried out in the same manner as in the formation of the undercoating layer.

A solution containing a platinum compound and an iridium compound is applied onto the above-formed intermediate layer, and then a resultant layer is heat-treated in an oxidizing atmosphere to form an overcoating layer which is formed of platinum metal and iridium oxide and contains, as metals, 60 to 99.9 at % of platinum and 0.1 to 40 at % of iridium.

The solution for the above application can be prepared by dissolving predetermined amounts of the same platinum compound as that used in the formation of the above undercoating layer and the same iridium compound as that used in the formation of the above intermediate layer in a proper solvent.

The above solvent is selected in the same manner as in the formation of the above undercoating layer or the above intermediate layer. The heat treatment in an oxidizing atmosphere is also carried out in the same manner as in the formation of the undercoating layer or the above intermediate layer, while the firing temperature is preferably in the range of from 400 to 600° C.

The platinum-iridium oxide overcoating layer is formed on the intermediate layer as described above, whereby the electrode of the present invention is obtained.

When an oxidizing atmosphere is not employed for the above heat treatment for the formation of any one of the above coating layers, i.e., the undercoating layer, the intermediate layer or the overcoating layer, the oxidation proceeds insufficiently, and metal is present in a free state, so that the resultant electrode has low durability.

The elctrolyzing electrode of the present invention is an electrode for electrolyzing a metal electrolytic solution, has a long lifetime in use as an ordinary anode, and is used as an electrolyzing electrode having sufficient durability even in a poor potential region.

The electrolytic metal may be any one of zinc, copper, nickel, iron, tin, bismuth, antimony, arsenic and various noble metals, while a desirable result can be obtained particularly when zinc is used. The electrode of the present invention can be applied to any one of various plating baths and electrolytic solutions used in electrolysis processes such as electroplating with the above metals, purification thereof, collection thereof, production of metal foils thereof and waste disposal thereof.

EXAMPLES

The present invention will be explained more in detail with reference to Examples hereinafter, while the present invention shall not be limited by these Examples.

Examples 1–7 and Comparative Examples 1–8

Chloroplatinic acid ($H_2PtCl_6.6H_2O$), tantalum ethoxide ($Ta(OC_2H_5)_5$) and chloroiridic acid ($H_2IrCl_6.6H_2O$) were dissolved in butanol in amount ratios so as to obtain a predetermined compositional ratio of platinum metal and tantalum oxide, of iridium oxide and tantalum oxide or of platinum metal and iridium oxide, whereby a coating solution for an undercoating layer, an intermediate layer or an overcoating layer was prepared. The coating solution had a platinum/tantalum compositional ratio, an iridium/tantalum compositional ratio or a platinum/iridium compositional ratio as shown in Table 1 or 2 and had a concentration of 80 g/l as metals.

First, a titanium substrate was etched with hot oxalic acid, the above coating solution for an undercoating layer was applied onto the titanium substrate with a brush, and the resultant layer was dried. Then, the titanium substrate with the layer was placed in an electric furnace, and the layer was baked at 500° C. with introducing air by blowing. The procedures of the above application, drying and baking were repeated a plurality of times as required until a predetermined coating amount was attained. In this manner, various undercoating layers containing platinum metal and tantalum oxide were formed as shown in Table 1 or 2. The coating amounts of the undercoating layers formed of platinum and tantalum oxide were adjusted to 0.3 to 0.7 mg/cm$^2$ as metals, and the coating amounts of other undercoating layers containing no platinum were also adjusted to equivalents amounts.

Then, the coating solution for an intermediate layer was applied onto the above undercoating layer with a brush, and the resultant layer was dried. Then, the substrate with the layer was placed in an electric furnace, and the layer was baked at 500° C. with introducing air by blowing. The procedures of the above application, drying and baking were repeated a plurality of times as required until a predetermined coating amount was attained. In this manner, various intermediate layers containing iridium oxide and tantalum oxide were formed as shown in Table 1 or 2. The coating amounts of the intermediate layers formed of iridium oxide and tantalum oxide were adjusted to 2.0 to 4.0 mg/cm$^2$ as metals, and the coating amount of an undercoating layer containing other metal was also adjusted to an equivalent amount.

Further, the coating solution for an overcoating layer was applied onto the above intermediate layer with a brush, and the resultant layer was dried. Then, the substrate with the layer was placed in an electric furnace, and the layer was baked at 500° C. with introducing air by blowing. The procedures of the above application, drying and baking were repeated a plurality of times as required until a predetermined coating amount was attained. In this manner, various overcoating layer containing platinum and iridium oxide were formed as shown in Table 1 or 2. The coating amounts of the overcoating layers formed of platinum and iridium oxide were adjusted to 0.3 to 0.7 mg/cm$^2$ as metals.

Each of the above-obtained electrodes was subjected to a life test in an aqueous solution containing 1 mol/l of sulfuric acid at 60° C. Each electrode was used as an anode, platinum was used as a cathode, and electrolysis was carried out at a current density of 300 A/dm$^2$. Tables 1 and 2 shows the results. The lifetime of each electrode in the aqueous solution containing 1 mol/l of sulfuric acid is expressed as follows.

◎: 6,000 hours or more

○: 4,000 hours to less than 6,000 hours

Δ: 3,000 hours to less than 4,000 hours

X: less than 3,000 hours

A time period taken until an electrolysis voltage was twice as high as an initial electrolysis voltage was considered to be a lifetime.

Further, each of the above-obtained electrodes was subjected to a life test in a polarity-reversed electrolysis in an aqueous solution containing 1 mol/l of sulfuric acid at room temperature. As an opposite electrode, the same electrode as the electrode under the test was used, and electrolysis was carried out at a current density of 100 A/dm$^2$ by reversing a polarity at intervals of 5 minutes as a positive polarization and 5 minutes as a negative polarization. Tables 1 and 2 show the results. The lifetime of each electrode in the polarity-reversed test in the aqueous solution containing 1 mol/l of sulfuric acid is expressed as follows.

◎: 1,500 hours or more

○: 800 hours to less than 1,500 hours

Δ: 200 hours to less than 800 hours

X: less than 200 hours

TABLE 1

| Sample | Electrically Conductive | Composition of under-coating layer (at %) | | Composition of inter-mediate layer (at %) | | | Ir amount of inter-mediate layer | Composition of over-coating layer (at %) | | Life test | |
|---|---|---|---|---|---|---|---|---|---|---|---|
| | | | | | | | | | | Positive | Polarity reversed |
| No. | Substrate | Pt | Ta | Ir | Ta | Pt | (mg/cm$^2$) | Pt | Ir | electrolysis | electrolysis |
| Ex. 1 | Ti | 2 | 98 | 75 | 25 | | 2.0 | 80 | 20 | ○ | ◎ |
| Ex. 2 | Ti | 5 | 95 | 80 | 20 | | 2.0 | 70 | 30 | ○ | ◎ |
| Ex. 3 | Ti | 2 | 98 | 80 | 20 | | 3.0 | 90 | 10 | ◎ | ◎ |
| Ex. 4 | Ti | 10 | 90 | 75 | 25 | | 4.0 | 80 | 20 | ◎ | ◎ |
| Ex. 5 | Ti | 15 | 85 | 85 | 15 | | 4.0 | 70 | 30 | ◎ | ◎ |
| Ex. 6 | Ti | 15 | 85 | 90 | 10 | | 3.0 | 95 | 5 | ◎ | ◎ |
| Ex. 7 | Ti | 20 | 80 | 85 | 15 | | 4.0 | 70 | 30 | ◎ | ◎ |
| Ex. 8 | Ti/Ta | 2 | 98 | 70 | 30 | | 2.0 | 80 | 20 | ◎ | ◎ |
| Ex. 9 | Ti/Ta | 5 | 95 | 80 | 20 | | 2.0 | 70 | 30 | ◎ | ◎ |
| Ex. 10 | Ti/Ta | 2 | 98 | 80 | 20 | | 3.0 | 90 | 10 | ◎ | ◎ |
| Ex. 11 | Ti/Ta | 10 | 90 | 75 | 25 | | 4.0 | 80 | 20 | ◎ | ◎ |
| Ex. 12 | Ti/Ta | 15 | 85 | 90 | 10 | | 3.0 | 95 | 5 | ◎ | ◎ |

*Ex.: Example

TABLE 2

| Sample | Electrically Conductive | Composition of under-coating layer (at %) | | Composition of inter-mediate layer (at %) | | | Ir amount of inter-mediate layer | Composition of over-coating layer (at %) | | Life test | |
|---|---|---|---|---|---|---|---|---|---|---|---|
| | | | | | | | | | | Positive | Polarity reversed |
| No. | Substrate | Pt | Ta | Ir | Ta | Pt | (mg/cm$^2$) | Pt | Ir | electrolysis | electrolysis |
| Comp. 1 | Ti | | 100 | 70 | 30 | | 2.0 | 80 | 20 | ○ | ◎ |
| Comp. 2 | Ti | 5 | 95 | 60 | 40 | | 2.0 | 70 | 30 | Δ | ○ |
| Comp. 3 | Ti | — | | 80 | 20 | | 3.0 | 90 | 10 | X | Δ |
| Comp. 4 | Ti | 10 | 90 | 75 | 25 | | 4.0 | — | | ◎ | Δ |

TABLE 2-continued

| Sample No. | Electrically Conductive Substrate | Composition of under-coating layer (at %) Pt | Ta | Composition of inter-mediate layer (at %) Ir | Ta | Pt | Ir amount of inter-mediate layer (mg/cm$^2$) | Composition of over-coating layer (at %) Pt | Ir | Life test Positive electrolysis | Polarity reversed electrolysis |
|---|---|---|---|---|---|---|---|---|---|---|---|
| Comp. 5 | Ti | 10 | 90 | 75 | 15 | 10 | 4.0 | 80 | 20 | Δ | ⊚ |
| Comp. 6 | Ti | 30 | 70 | 85 | 15 | | 4.0 | 70 | 30 | Δ | ⊚ |
| Comp. 7 | Ti | 100 | | 80 | 20 | | 3.0 | 80 | 20 | X | ⊚ |
| Comp. 8 | Ti | | 100 | 80 | 20 | | 3.0 | — | | ⊚ | X |
| Comp. 9 | Ti/Ta | — | | 75 | 25 | | 2.0 | — | | ⊚ | X |
| Comp. 10 | Ti/Ta | 10 | 90 | 85 | 15 | | 3.0 | — | | ⊚ | Δ |
| Comp. 11 | Ti/Ta | | 100 | 60 | 40 | | 3.0 | 70 | 30 | Δ | ⊚ |

*Comp.: Comparative Examples

The electrodes according to the present invention showed a longer lifetime both in use as ordinary anodes and in the polarity-reversed electrolysis as compared with the electrodes of Comparative Examples.

Examples 8–12 and Comparative Examples 9–11

Electrodes were prepared in the same manner as in Examples 1 to 7 except that the electrically conductive substrates were replaced with substrates obtained by forming, by a sputtering method, a tantalum layer having a thickness of 0.7 to 0.9 $\mu$m on a titanium substrate which had been etched with hot oxalic acid. The electrodes were subjected to the same life test as that in Examples 1 to 7. Tables 1 and 2 show the results.

The above-obtained electrodes (Examples 8 to 12) showed a far longer life than the electrodes (Examples 1 to 7) using titanium as a substrate.

As described above, the present invention can provide an electrolyzing electrode which is for electrolyzing a metal electrolytic solution, which shows a long lifetime in ordinary anodic polarization, and which has sufficient be durability even when placed in a poor potential region, and a process for the production thereof.

What is claimed is:

1. An electrolyzing electrode having an undercoating layer which is formed of platinum metal and tantalum oxide and contains, as metals, 1 to 20 at % of platinum and 80 to 99 at % of tantalum, on an electrically conductive electrode substrate, having an intermediate layer which is formed of iridium oxide and tantalum oxide and contains, as metals, 70 to 99.9 at % of iridium and 0.1 to 30 at % of tantalum, on the undercoating layer, and further having an overcoating layer which is formed of platinum metal and iridium oxide and contains, as metals, 60 to 99.9 at % of platinum and 0.1 to 40 at % of iridium, on the intermediate layer.

2. The electrolyzing electrode of claim 1, wherein the electrically conductive electrode substrate is a substrate formed of a titanium substrate and a tantalum layer formed on the titanium substrate.

3. A process for the production of the electrolyzing electrode of claim 1, which process comprises applying a solution containing a platinum compound and a tantalum compound onto an electrically conductive electrode substrate, then, heat-treating a resultant layer in an oxidizing atmosphere to form an undercoating layer which is composed of platinum metal and tantalum oxide and contains, as metals, 1 to 20 at % of platinum and 80 to 99 at % of tantalum on the electrically conductive electrode substrate, then, applying a solution containing an iridium compound and a tantalum compound onto the undercoating layer, heat-treating a resultant layer in an oxidizing atmosphere to form an intermediate layer which is composed of iridium oxide and tantalum oxide and contains, as metals, 70 to 99.9 at % of iridium and 0.1 to 30 at % of tantalum on the undercoating layer, further, applying a solution containing a platinum compound and an iridium compound onto the intermediate layer, and heat-treating a resultant layer in an oxidizing atmosphere to form an overcoating layer which is formed of platinum metal and iridium oxide and contains, as metals, 60 to 99.9 at % of platinum and 0.1 to 40 at % of iridium, on the intermediate layer.

4. The process of claim 3, wherein the electrically conductive electrode substrate is a substrate formed of a titanium substrate and a tantalum layer formed on the titanium substrate.

5. In an electrolysis process comprising conducting electrolysis in the presence of an anode and a cathode, the improvement comprising using the electrolyzing electrode of claim 1 as the anode.

* * * * *